US012059111B2

(12) United States Patent
Liang

(10) Patent No.: US 12,059,111 B2
(45) Date of Patent: Aug. 13, 2024

(54) CLEANING ROLLER AND ROLLING STEAM MOP

(71) Applicants: Zhongshan Kamshing Home Electrical Appliance Co., Ltd, Zhongshan (CN); Jinran Liang, Zhongshan (CN)

(72) Inventor: Jinran Liang, Zhongshan (CN)

( * ) Notice: Subject to any disclaimer, the term of this patent is extended or adjusted under 35 U.S.C. 154(b) by 361 days.

(21) Appl. No.: 17/613,471

(22) PCT Filed: Jul. 30, 2019

(86) PCT No.: PCT/CN2019/098461
§ 371 (c)(1),
(2) Date: Nov. 22, 2021

(87) PCT Pub. No.: WO2020/232830
PCT Pub. Date: Nov. 26, 2020

(65) Prior Publication Data

US 2022/0218172 A1 Jul. 14, 2022

(30) Foreign Application Priority Data

May 23, 2019 (CN) ..... 201910435480.7

(51) Int. Cl.
*A47L 11/40* (2006.01)
*A47L 11/282* (2006.01)

(52) U.S. Cl.
CPC ..... *A47L 11/4088* (2013.01); *A47L 11/282* (2013.01); *A47L 11/4041* (2013.01); *A47L 11/4069* (2013.01); *A47L 11/4086* (2013.01)

(58) Field of Classification Search
None
See application file for complete search history.

(56) References Cited

U.S. PATENT DOCUMENTS 3,172,138 A * 3/1965 Price ..... A47L 11/18 451/352
2011/0191968 A1* 8/2011 Moes ..... A47L 11/4069 15/21.1

FOREIGN PATENT DOCUMENTS

CN 208677297 U * 4/2019

OTHER PUBLICATIONS

CN-208677297-U translation (Year: 2019).*

* cited by examiner

*Primary Examiner* — Abbie E Quann
(74) *Attorney, Agent, or Firm* — Novoclaims Patent Services LLC; Mei Lin Wong

(57) ABSTRACT

Disclosed are a cleaning roller and a rolling steam mop. The cleaning roller includes a central shaft capable of rotating, a steam channel, and a cleaning layer. The steam channel is provided with a steam inlet and a plurality of first steam outlets; the steam inlet is used for communicating with a steam generation device: the plurality of first steam outlets are distributed in an axial direction of the central shaft. The cleaning layer is provided around the central shaft; and the steam flowing out from the first steam outlets can be diffused outwards through the cleaning layer When in use, the steam generated by the steam generation device enters the steam channel through the steam inlet, and then flows out from the first steam outlets, and is diffused outwards through the cleaning layer, so that the steam can be diffused to an object to be cleaned.

8 Claims, 8 Drawing Sheets

CLEANING ROLLER AND ROLLING STEAM MOP

CROSS REFERENCE OF RELATED APPLICATION

This is a national phase national application of an international patent application number PCT/CN2019/098461 with a filing date of Jul. 30, 2019, which claimed priority of Chinese application number 201910435480.7, filing date May 23, 2019. The contents of these specifications, including any intervening amendments thereto, are incorporated herein by reference.

BACKGROUND OF THE PRESENT INVENTION

Field of Invention

The invention relates to the field of cleaning equipment, in particular to a cleaning roller and a rolling steam mop.

Description of Related Arts

With the development of society, people's living stand of is becoming increasingly higher, and rolling mops are used more and more widely. In the prior art, the rolling mop typically comprises a driving mechanism and a cleaning roller. When the rolling mop is used, users spay water to an object to be cleaned, and then the driving mechanism drives the cleaning roller to rotate to clean the object. Of course, some of existing rolling mops are also provided with a water sprayer used for spraying cleaning water onto a floor to be cleaned. However, if the cleaning water is directly sprayed onto the floor to be cleaned, the cleaning water may be too concentrated, which is not beneficial for more effective cleaning the floor to be cleaned by the cleaning roller, and makes the floor to be cleaned too slippery to cause potential safety accidents.

SUMMARY OF THE PRESENT INVENTION

The objective of the invention is to provide a cleaning roller and a rolling steam mop, which are simple in structure, convenient to use, and high in practicability.

To fulfill the above objective, the invention adopts the following technical solution:

The invention provides a cleaning roller, comprising a central shaft capable of rotating, a steam channel, and a cleaning layer, wherein the steam channel is provided with a steam inlet and a plurality of first steam outlets, the steam inlet is used for communicating with a steam generation device, the plurality of first steam outlets are distributed in an axial direction of the central shaft, the cleaning layer is disposed around the central shaft, and steam flowing out from the first steam outlets is diffused outwards through the cleaning layer.

The central shaft is hollow, so that the steam channel is formed in the central shaft.

The steam roller further comprises an inlet sleeve, an inlet through-hole is formed in a side wall of the central shaft to form the steam inlet, and the inlet through-hole of the central shaft is sleeved with the inlet sleeve; support portions are disposed on inner walls of two ends of the inlet sleeve, so that a gap is reserved between the inlet sleeve and the inlet through-hole of the central shaft to form an air inlet passage surrounding the inlet through-hole; and a vent is formed in a side wall of the inlet sleeve and communicates with the steam generation device.

Outlet through-holes are formed in the side wall of the central shaft to form the first steam outlets.

The central shaft comprises a driving mechanism connection portion disposed in the middle and end shafts disposed on two sides of the driving mechanism connection portion, the driving mechanism connection portion is connected to a driving mechanism to enable the driving mechanism to drive the cleaning roller to rotate, and the cleaning layer is disposed around the end shafts.

Support sleeves are disposed between the end shafts and the cleaning layer, the cleaning layer is mounted around the support sleeves, and second steam outlets are formed in side walls of the support sleeves and communicate with the first steam outlets.

Each of the support sleeves comprises a first sleeve and a second sleeve, the first sleeves are sleeved with the second sleeves, and sealing structures are disposed in the first sleeves and the second sleeves.

The sealing structures in the second sleeves are sealing plugs, and connection portions extend from the sealing plugs toward the end shafts and are connected to the end shafts.

First clamping grooves are formed in outer walls of the end shafts, first clamping blocks are disposed on inner walls of the first sleeves and are clamped in the first clamping grooves, second clamping blocks are disposed on outer walls of the first sleeves, second clamping grooves are formed in inner walls of the second sleeves, and the second clamping blocks are clamped in the second clamping grooves.

The cleaning layer is a cleaning cloth layer or a cleaning drum, third steam outlets are formed in a side wall of the cleaning drum, and cleaning teeth are disposed on an outer wall of the cleaning drum.

The invention further provides a rolling steam mop comprising a mount, wherein the cleaning roller mentioned above, a steam generation device, and a driving mechanism are disposed on the mount, the steam inlet of the cleaning roller communicates with the steam generation device, and the driving mechanism is used for driving the cleaning roller to rotate.

The steam generation device comprises a water tank, a steam generator and a water pump that communicate with each other sequentially, and the steam inlet of the cleaning roller communicates with the water pump.

The invention has the following beneficial effects: through the above structural arrangement, when the cleaning roller is used, the central shaft rotates to drive the cleaning layer to rotate to clean the surface of an object to be cleaned in a rolling manner. Specifically, steam generated by the steam generation device enters the steam channel via the steam inlet, then flows out of the steam channel via the first steam outlets, and is diffused outwards through the cleaning layer, so that the steam can be diffused to the object to be cleaned, and cleaning water can more evenly adhere to the surface of the object to be cleaned. In this way, the cleaning roller can effectively clean the surface of the object to be cleaned; and the surface of the object to be cleaned will not be too wet, so that safety accidents are avoided. Specifically, when the cleaning layer is the cleaning cloth layer, steam wets the cleaning cloth layer to be used for cleaning, or passes through the cleaning cloth layer to be diffused outwards, and the cleaning cloth layer can be used for cleaning floors, walls, glass surfaces, and the like; or, when the cleaning layer is the cleaning drum, steam is directly diffused outwards via third steam outlets in the cleaning drum, and the cleaning drum can be used for cleaning carpets, blankets, and the like.

DETAILED DESCRIPTION OF THE PREFERRED EMBODIMENT

The invention will be further described below in conjunction with the accompanying drawings and specific embodiments.

Embodiment 1

Figure 1:
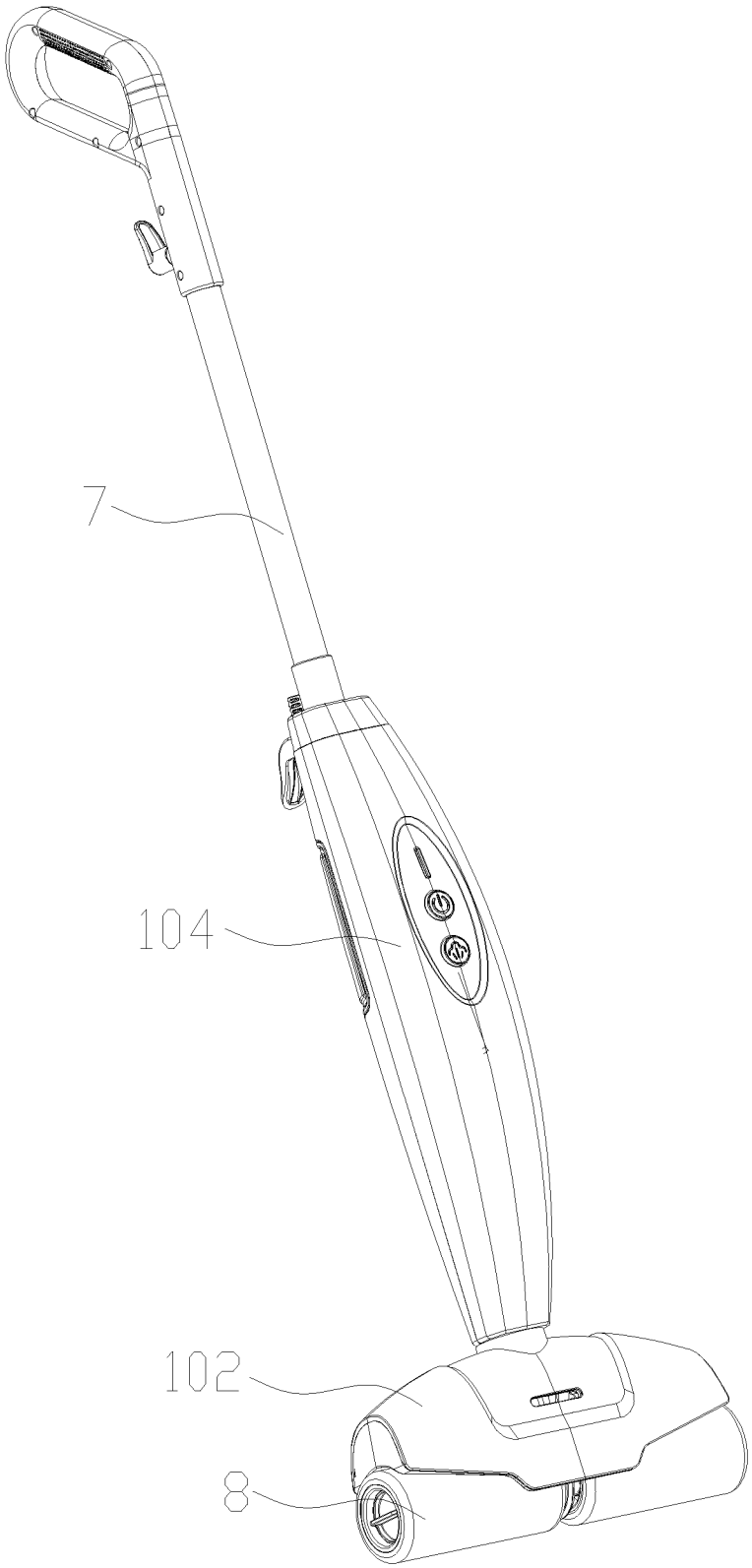
FIG. 1 is a structural view of the invention, wherein a cleaning layer is a cleaning cloth layer.
Figure 2:
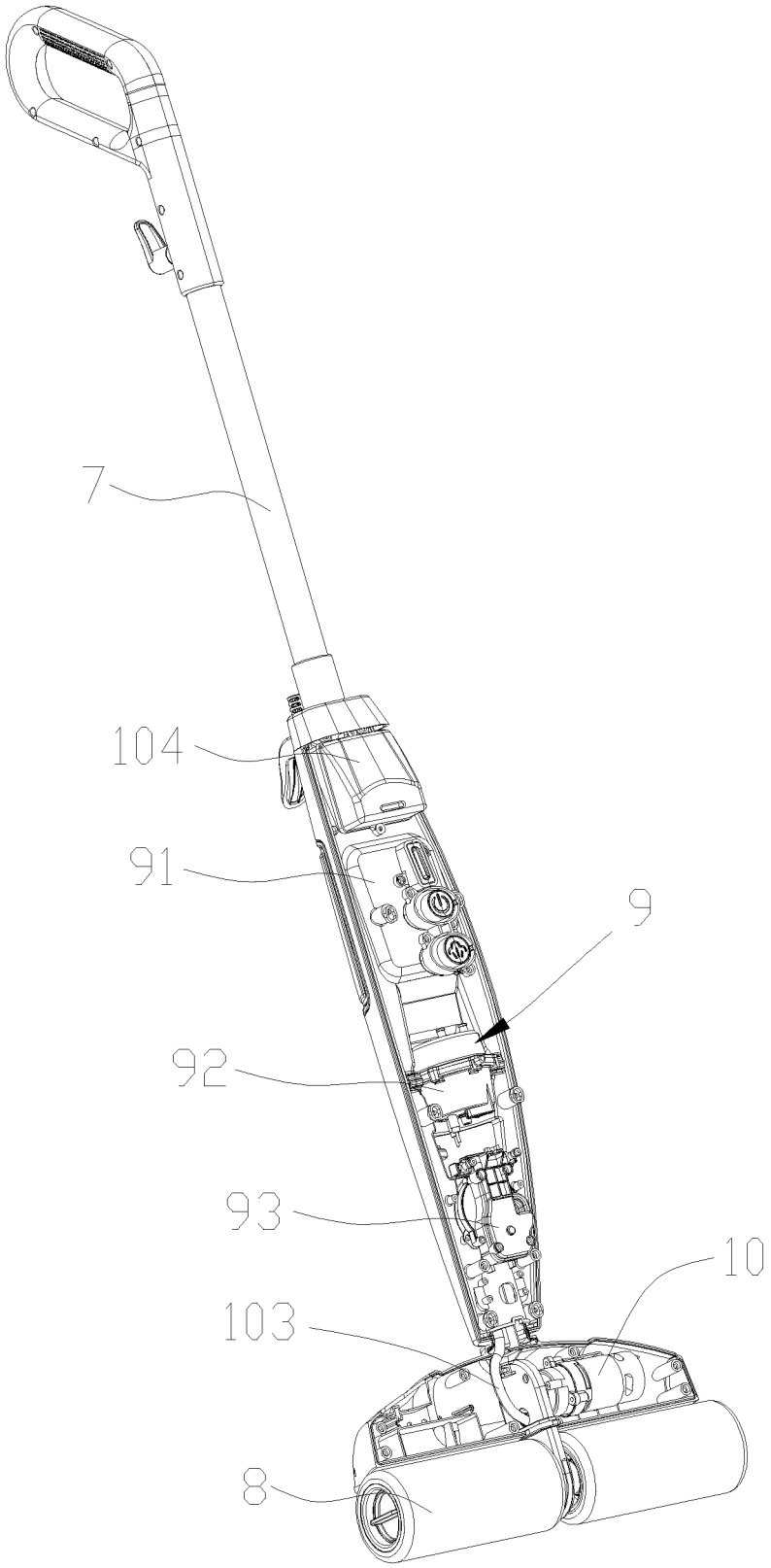
FIG. 2 is an exploded view of FIG. 1 and illustrates a steam generation device and a driving mechanism.
Figure 3:
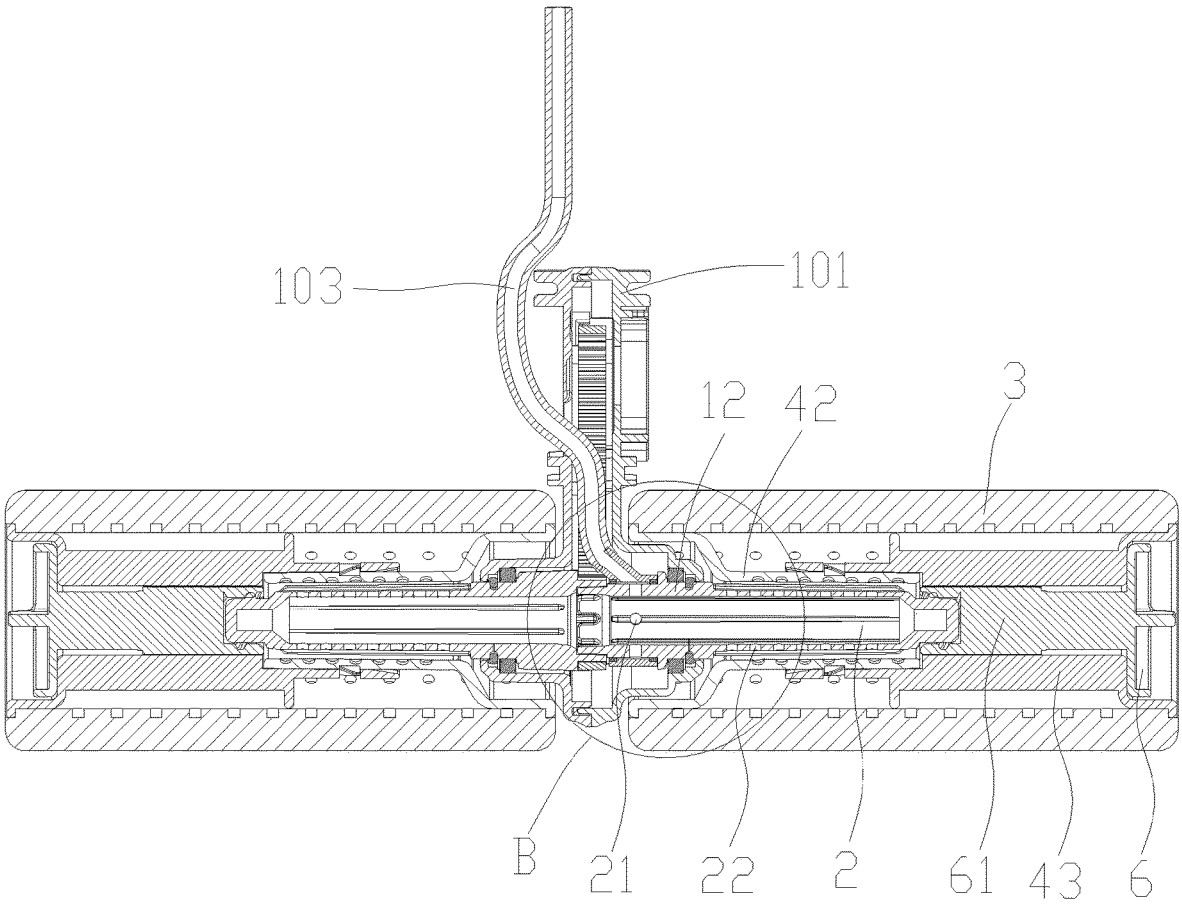
FIG. 3 is a sectional view of a cleaning roller.

Referring to FIG. 1 to FIG. 3, a cleaning roller comprises a central shaft 1 capable of rotating, a steam channel 2 and a cleaning layer 3, wherein the steam channel 2 is provided with a steam inlet 21 and a plurality of steam outlets 22, the steam inlet 21 is used for communicating with a steam generation device 9, the plurality of first steam outlets 22 are distributed in an axial direction of the central shaft 1, the cleaning layer 3 is provided around the central shaft 1, and steam flowing out from the first steam outlets 22 is diffused outwards through the cleaning layer 3.

Through the above structural arrangement, when the cleaning roller is used, the central shaft rotates to drive the cleaning layer to rotate, so that the cleaning roller can roll to clean the surface of an object to be cleaned. Specifically, steam generated by the steam generation device enters the steam channel via the steam inlet, then flows out of the steam channel via the first steam outlets, and is diffused outwards through the cleaning layer, so that the steam can be diffused to the object to be cleaned, and cleaning water can more evenly adhere to the surface of the object to be cleaned. In this way, the cleaning roller can effectively clean the surface of the object to be cleaned; and the surface of the object to be cleaned will not be too wet, so that safety accidents are avoided.

As a preferred implementation of this embodiment, the central shaft 1 is hollow, so that the steam channel 2 is formed in the central shaft 1. In this way, the steam channel does not need to be arranged separately, so the structure is simple, and the design is ingenious. Further, through holes are formed in a side wall of the central shaft 1 to form the first steam outlets 22.

Figure 4:
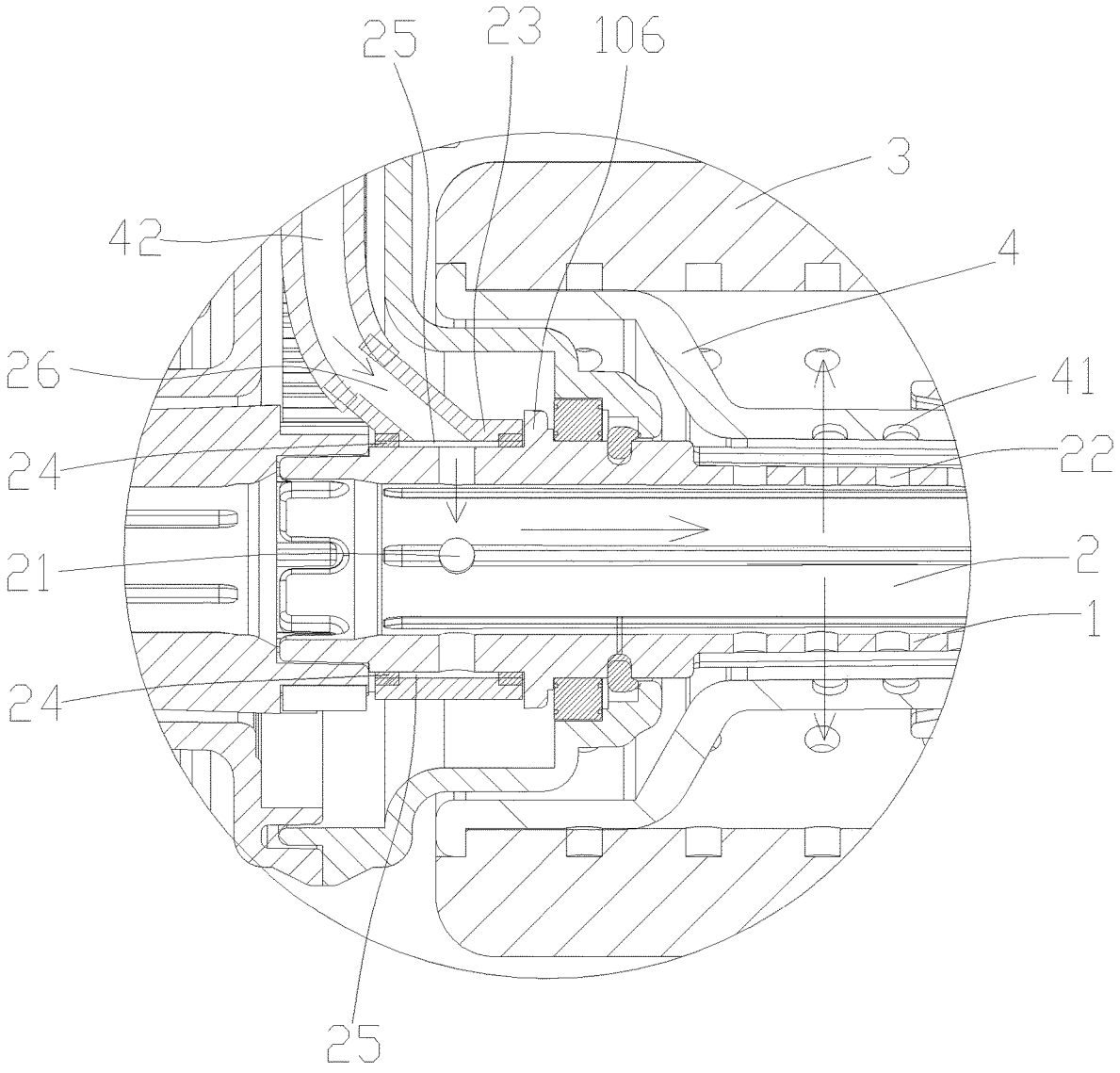
FIG. 4 is an enlarged view of part B in FIG. 3.
Figure 5:
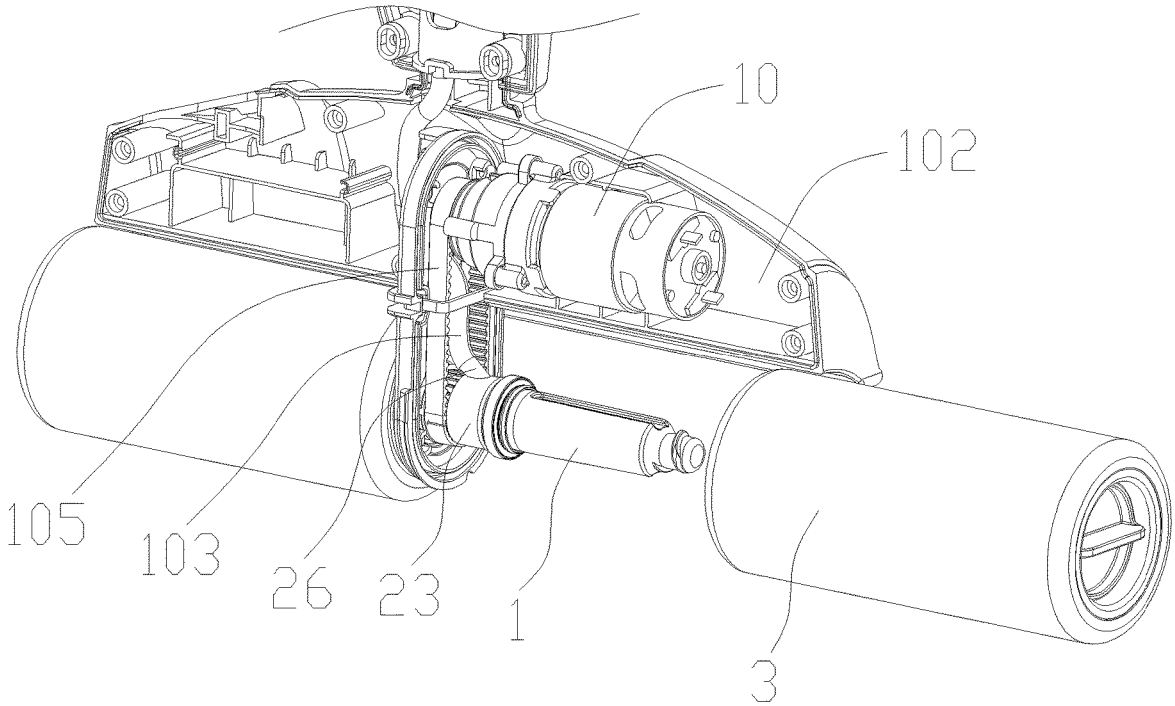
FIG. 5 is an assembled view of the cleaning roller.
Figure 6:
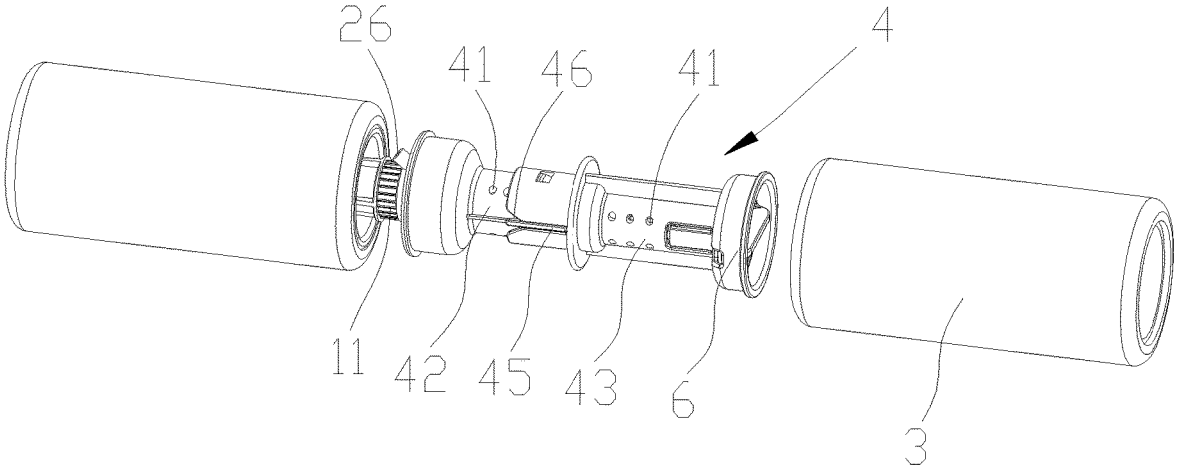
FIG. 6 is a disassembled view of the cleaning roller, wherein a cleaning layer is disassembled.
Figure 7:
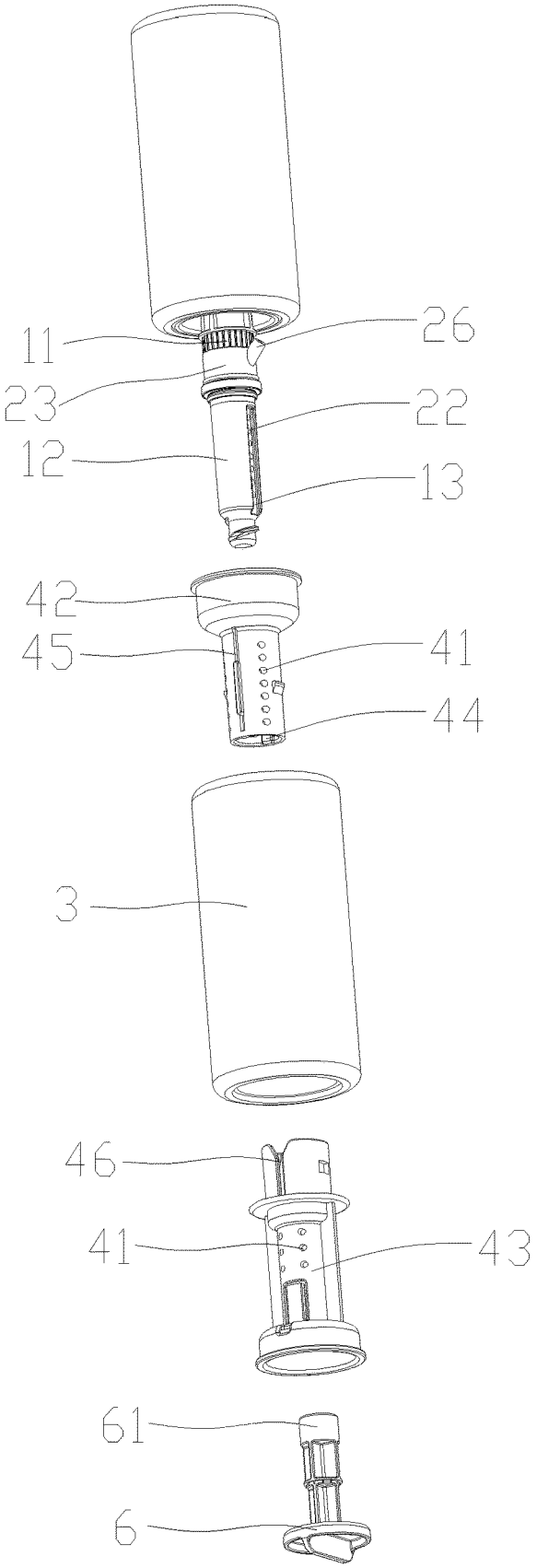
FIG. 7 is a disassembled view of the cleaning roller, wherein first sleeves, a cleaning layer, second sleeves and sealing plugs are sequentially disassembled.

In this embodiment, referring to FIG. 4, the cleaning roller further comprises an inlet sleeve 23, an inlet through-hole is formed in the side wall of the central shaft 1 to form the steam inlet 21, the inlet through-hole of the central shaft 1 is sleeved with the inlet sleeve 23, and support portions 24 are disposed on inner walls of two ends of the inlet sleeve 23, so that a gap is reserved between the inlet sleeve 23 and the inlet through-hole of the central shaft 1 to form an air inlet passage 25 surrounding the inlet through-hole; and a vent 26 is formed in a side wall of the inlet sleeve 23 and communicates with the steam generation device 9.

The inlet sleeve is arranged to form an air inlet passage; when the cleaning roller is used, steam sequentially passes through the vent, the air inlet passage and the steam inlet to enter the steam channel. In addition, because the inlet sleeve is disposed around the central shaft, that is, the central shaft is able to rotate with respect to the inlet sleeve, when the central shaft rotates (when the cleaning roller works), the inlet sleeve does not rotate to keep the position of the vent unchanged to ensure that the vent communicates with the steam generation device, so that the structure is simple, and the design is ingenious. Wherein, the support portions may be sealing rings and can fulfill a support effect and a sealing effect without exerting an excessive influence on the rotation of the central shaft. Moreover, four inlet through-holes may be configured and distributed in the axial direction of the central shaft. Stop protrusions 106 are disposed on two sides of the inlet sleeve to prevent the inlet sleeve from moving leftwards or rightwards, such that the structural stability is guaranteed.

In this embodiment, referring to FIG. 3 to FIG. 7, the central shaft 1 comprises a driving mechanism connection portion 11 disposed in the middle and end shafts 12 disposed on two sides of the driving mechanism connection portion 11, the driving mechanism connection portion 11 is connected to a driving mechanism 10 to enable the driving mechanism to drive the cleaning roller 8 to rotate, and the cleaning layer 3 is disposed around the end shafts 12, such that the structure is simple, and the design is reasonable. Wherein, the end shafts are hollow, and the first steam outlets are distributed in an axial direction of the end shafts.

Furthermore, support sleeves 4 are disposed between the end shafts 12 and the cleaning layer 3, the cleaning layer 3 is mounted around the support sleeves 4, and second steam outlets 41 are formed in side walls of the support sleeves 4 and communicate with the first steam outlets 22. When the cleaning roller is used, steam flowing out of the steam channel sequentially passes through the first steam outlets and the second steam outlets, and is then diffused outwards through the cleaning layer. The cleaning layer is mounted around the support sleeves, thus being easy to assemble.

Specifically, each of the support sleeves 4 comprises a first sleeve 42 and a second sleeve 43, the first sleeves 42 are sleeved with the second sleeves 43, and sealing structures are disposed in the first sleeves 42 and the second sleeves 43. Steam can be prevented, to some extent, from leaking between the support sleeves and the central shaft, so that the reliability of the product is improved. Wherein, the first sleeves and the second sleeves may be clamped and connected with each other.

Furthermore, the sealing structures 6 in the second sleeves 43 are sealing plugs 6, and connection portions 61 extend from the sealing plugs 6 towards the end shafts 12 and are connected to the end shafts 12. In this way, the second sleeves can be fixed to the central shaft by means of the sealing plugs, which makes the structure simple and reliable. Wherein, the connection portions and the end shafts may be connected in a threaded manner, such that the cleaning roller can be assembled and disassembled easily.

In this embodiment, first clamping grooves 13 are formed in outer walls of the end shafts 12, first clamping blocks 44 are disposed on inner wall of the first sleeves 42, and the first clamping blocks 44 are clamped in the first clamping grooves 13, such that the first sleeves are driven to rotate when the central shaft rotates, and the structure is simple and reliable. Similarly, second clamping blocks 45 are disposed on outer walls of the first sleeves 42, second clamping grooves 46 are formed in inner walls of the second sleeves 43, and the second clamping blocks 45 are clamped in the second clamping grooves 46, such that the second sleeves are driven to rotate when the first sleeves rotate, and the structure is simple and reliable.

Figure 8:
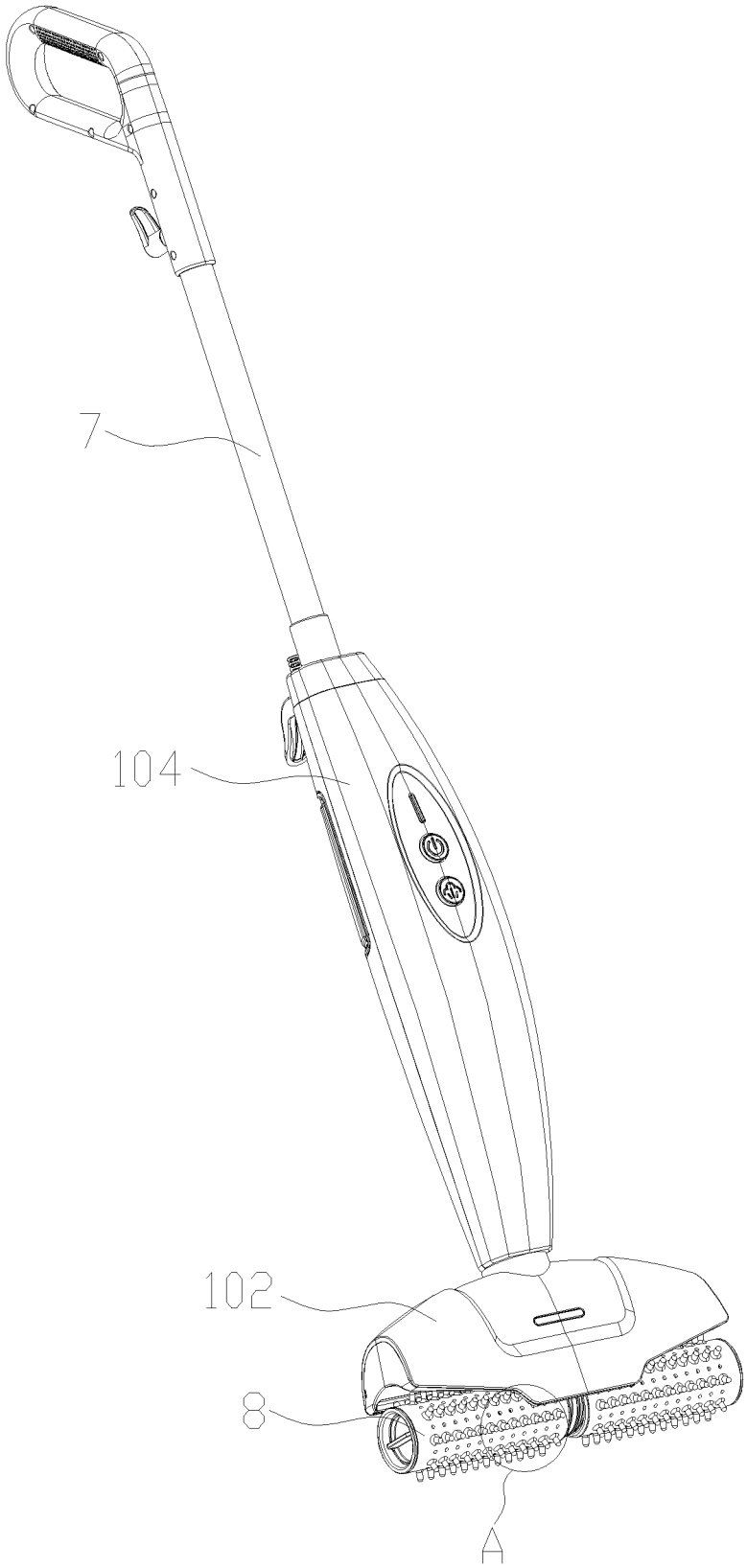
FIG. 8 is a structural view of the invention, wherein the cleaning layer is a cleaning drum.
Figure 9:
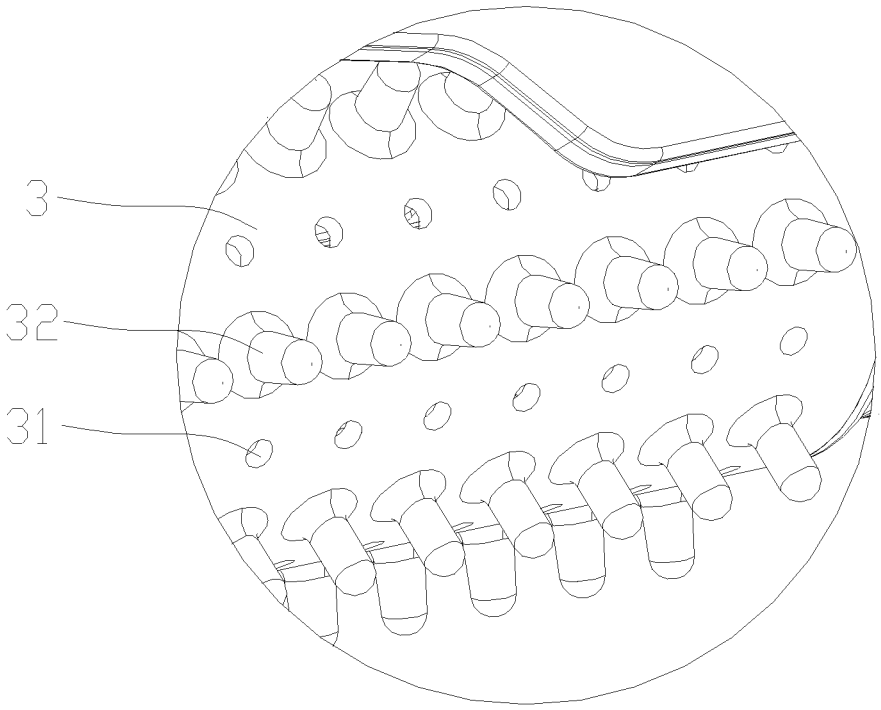
FIG. 9 is an enlarged view of part A in FIG. 8.

In this embodiment, the cleaning layer 3 is a cleaning cloth layer or a cleaning drum, wherein third steam outlets 31 are formed in a side wall of the cleaning drum, and cleaning teeth 32 are disposed on an outer wall of the cleaning drum. Specifically, referring to FIG. 1, when the cleaning layer is the cleaning cloth layer, steam wets the cleaning cloth layer to be used for cleaning, or passes through the cleaning cloth layer to be diffused outwards, and the cleaning cloth layer can be used for cleaning floors, walls, glass surfaces, and the like. Referring to FIG. 8 and FIG. 9, when the cleaning layer is the cleaning drum, steam flowing out of the steam channel sequentially passes through the first steam outlets, the second steam outlets and the third steam outlets to be diffused outwards to effectively remove impurities such as hair together with the cleaning teeth, and the cleaning drum can be used for cleaning carpets, blankets, and the like.

Embodiment 2

Referring to FIG. 1 to FIG. 9, a rolling steam mop comprises a mount 7, wherein the cleaning roller 8 mentioned above, a steam generation device 9, and a driving mechanism 10 are disposed on the mount 7, the steam inlet 21 of the cleaning roller 8 communicates with the steam generation device 9, and the driving mechanism 10 is used for driving the cleaning roller 8 to rotate.

Wherein, the driving mechanism connection portion of the central shaft of the cleaning roller may be a toothed shaft, and the tooth shaft may be integrally formed with one end shaft; the driving mechanism may be a motor connected to the toothed shaft by means of a belt 105, such that the central shaft can be driven by the motor. Moreover, a protection shell 101 is disposed at the position of the belt and a toothed surface. The protection shell extends into the first sleeves to form the sealing structures in the first sleeves. Further, the mount is provided with a first shell 102, the driving mechanism and the cleaning roller are disposed on the first shell, and the cleaning roller is exposed out of the first shell.

The rolling steam mop in this embodiment comprises the cleaning roller mentioned above. Through the structural arrangement of the cleaning roller, during use, the central shaft rotates to drive the cleaning layer to rotate to clean the surface of an object to be cleaned in a rolling manner. Specifically, steam generated by the steam generation device enters the steam channel via the steam inlet, then flows out of the steam channel via the first steam outlets, and is diffused outwards through the cleaning layer, so that the steam can be diffused to the object to be cleaned, and cleaning water can more evenly adhere to the surface of the object to be cleaned. In this way, the cleaning roller can effectively clean the surface of the object to be cleaned; and the surface of the object to be cleaned will not be too wet, so that safety accidents are avoided. Specifically, when the cleaning layer is a cleaning cloth layer, steam wets the cleaning cloth layer to be used for cleaning, or passes through the cleaning cloth layer to be diffused outwards, and the cleaning cloth layer can be used for cleaning floors, walls, glass surfaces, and the like; or, when the cleaning layer is a cleaning drum, steam is directly diffused outwards via third steam outlets in the cleaning drum, and the cleaning drum can be used for cleaning carpets, blankets, and the like.

In this embodiment, the steam generation device 9 comprises a water tank 91, a steam generator 92, and water pump 93 that communicate with each other in sequence, and the steam inlet 21 of the cleaning roller 8 communicates with the water pump 93. Wherein, the water pump communicates with the vent of the cleaning roller by means of a pipe 103. Further, the mount is provided with a second shell 104, and the water tank, the steam generator and the water pump are all disposed in the second shell.

Those skilled in the art can make other corresponding variations and transformations according to the technical solution and concept described above, and all these variations and transformations should fall within the protection scope of the claims of the invention.

What is claimed is:

1. A cleaning roller, comprising a central shaft (1) capable of rotating, a steam channel (2), and a cleaning layer (3), wherein the steam channel (2) is provided with a steam inlet (21) and a plurality of first steam outlets (22), the steam inlet (21) is used for communicating with a steam generation device (9), the plurality of first steam outlets (22) are distributed in an axial direction of the central shaft (1), the cleaning layer (3) is disposed around the central shaft (1), and steam flowing out from the first steam outlets (22) is diffused outwards through the cleaning layer (3);

the central shaft (1) is hollow, so that the steam channel (2) is formed in the central shaft (1);

the cleaning roller further comprises an inlet sleeve (23), an inlet through-hole is formed in a side wall of the central shaft (1) to form the steam inlet (21), and the inlet through-hole of the central shaft (1) is sleeved with the inlet sleeve (23); support portions (24) are disposed on inner walls of two ends of the inlet sleeve (23), so that a gap is reserved between the inlet sleeve (23) and the inlet through-hole of the central shaft (1) to form an air inlet passage (25) surrounding the inlet through-hole; and a vent (26) is formed in a side wall of the inlet sleeve (23) and communicates with the steam generation device (9), wherein the central shaft (1) comprises a driving mechanism connection portion (11) disposed in a middle and end shafts (12) disposed on two sides of the driving mechanism connection portion (11), the driving mechanism connection portion (11) is connected to a driving mechanism (10) to enable the driving mechanism to drive the cleaning roller (8) to rotate, and the cleaning layer (3) is disposed around the end shafts (12), wherein support sleeves (4) are disposed between the end shafts (12) and the cleaning layer (3), the cleaning layer (3) is mounted around the support sleeves (4), and second steam outlets (41) are formed in side walls of the support sleeves (4) and communicate with the first steam outlets (22).

2. The cleaning roller according to claim 1, wherein each of the support sleeves (4) comprises a first sleeve (42) and a second sleeve (43), the first sleeves (42) are sleeved with the second sleeves (43), and sealing structures are disposed in the first sleeves (42) and the second sleeves (43).

3. The cleaning roller according to claim 2, wherein the sealing structures in the second sleeves (43) are sealing plugs (6), and connection portions (61) extend from the sealing plugs (6) toward the end shafts (12) and are connected to the end shafts (12).

4. The cleaning roller according to claim 2, wherein first clamping grooves (13) are formed in outer walls of the end shafts (12), first clamping blocks (44) are disposed on inner walls of the first sleeves (42) and are clamped in the first clamping grooves (13), second clamping blocks (45) are disposed on outer walls of the first sleeves (42), second clamping grooves (46) are formed in inner walls of the second sleeves (43), and the second clamping blocks (45) are clamped in the second clamping grooves (46).

5. A rolling steam mop, comprising a mount (7), wherein a cleaning roller (8), a steam generation device (9), and a driving mechanism (10) are disposed on the mount (7), the cleaning roller (8) comprises a central shaft (1) capable of rotating, a steam channel (2), and a cleaning layer (3), the steam channel (2) is provided with a steam inlet (21) and a plurality of first steam outlets (22), the steam inlet (21) is used for communicating with the steam generation device (9), the plurality of first steam outlets (22) are distributed in an axial direction of the central shaft (1), the cleaning layer (3) is disposed around the central shaft (1), and steam flowing out from the first steam outlets (22) is diffused outwards through the cleaning layer (3); the central shaft (1) is hollow, so that the steam channel (2) is formed in the central shaft (1); the cleaning roller further comprises an inlet sleeve (23), an inlet through-hole is formed in a side wall of the central shaft (1) to form the steam inlet (21), and the inlet through-hole of the central shaft (1) is sleeved with the inlet sleeve (23); support portions (24) are disposed on inner walls of two ends of the inlet sleeve (23), so that a gap is reserved between the inlet sleeve (23) and the inlet through-hole of the central shaft (1) to form an air inlet passage (25) surrounding the inlet through-hole; a vent (26) is formed in a side wall of the inlet sleeve (23) and communicates with the steam generation device (9); and the steam inlet (21) of the cleaning roller communicates with the steam generation device (9), and the driving mechanism (10) is used for driving the cleaning roller (8) to rotate, wherein the central shaft (1) comprises a driving mechanism connection portion (11) disposed in a middle and end shafts (12) disposed on two sides of the driving mechanism connection portion (11), the driving mechanism connection portion (11) is connected to the driving mechanism (10) to enable the driving mechanism to drive the cleaning roller (8) to rotate, and the cleaning layer (3) is disposed around the end shafts (12), wherein support sleeves (4) are disposed between the end shafts (12) and the cleaning layer (3), the cleaning layer (3) is mounted around the support sleeves (4), and second steam outlets (41) are formed in side walls of the support sleeves (4) and communicate with the first steam outlets (22).

6. The rolling steam mop according to claim 5, wherein each of the support sleeves (4) comprises a first sleeve (42) and a second sleeve (43), the first sleeves (42) are sleeved with the second sleeves (43), and sealing structures are disposed in the first sleeves (42) and the second sleeves (43).

7. The rolling steam mop according to claim 6, wherein the sealing structures in the second sleeves (43) are sealing plugs (6), and connection portions (61) extend from the sealing plugs (6) toward the end shafts (12) and are connected to the end shafts (12).

8. The rolling steam mop according to claim 6, wherein first clamping grooves (13) are formed in outer walls of the end shafts (12), first clamping blocks (44) are disposed on inner walls of the first sleeves (42) and are clamped in the first clamping grooves (13), second clamping blocks (45) are disposed on outer walls of the first sleeves (42), second clamping grooves (46) are formed in inner walls of the second sleeves (43), and the second clamping blocks (45) are clamped in the second clamping grooves (46).

* * * * *